US010407282B2

(12) United States Patent
Henikl et al.

(10) Patent No.: US 10,407,282 B2
(45) Date of Patent: Sep. 10, 2019

(54) POSITION CONTROL OF A BOOM TIP

(71) Applicant: SCHWING GMBH, Herne (DE)

(72) Inventors: Johannes Henikl, Essen (DE); Wolfgang Kemmetmüller, Vienna (AT); Andreas Kugi, Vienna (AT)

(73) Assignee: Schwing GmbH, Herne (DE)

( * ) Notice: Subject to any disclaimer, the term of this patent is extended or adjusted under 35 U.S.C. 154(b) by 0 days.

(21) Appl. No.: 15/552,165

(22) PCT Filed: Feb. 19, 2016

(86) PCT No.: PCT/EP2016/053596

§ 371 (c)(1),
(2) Date: Aug. 18, 2017

(87) PCT Pub. No.: WO2016/131977

PCT Pub. Date: Aug. 25, 2016

(65) Prior Publication Data

US 2018/0037444 A1 Feb. 8, 2018

(30) Foreign Application Priority Data

Feb. 19, 2015 (DE) ..... 10 2015 102 368

(51) Int. Cl.

| | |
|---|---|
| ***B66C 13/46*** | (2006.01) |
| ***B66C 13/06*** | (2006.01) |
| ***E04G 21/04*** | (2006.01) |

(52) U.S. Cl.

CPC ..... *B66C 13/46* (2013.01); *B66C 13/066* (2013.01); *E04G 21/0463* (2013.01)

(58) Field of Classification Search

CPC .... B66C 13/46; B66C 13/066; E04G 21/0463
See application file for complete search history.

(56) References Cited

U.S. PATENT DOCUMENTS 5,735,065 A * 4/1998 Yamagata ..... E02F 3/437 37/348
6,275,757 B1 * 8/2001 Watanabe ..... E02F 3/437 172/6

(Continued)

FOREIGN PATENT DOCUMENTS

EP 1537282 B1 6/2005
EP 2347988 A1 7/2011

(Continued)

OTHER PUBLICATIONS

International Preliminary Report on Patentability (English translation) issued in PCT/EP2016/053596, dated Aug. 31, 2017, 8 pages.

(Continued)

*Primary Examiner* — Behrang Badii
*Assistant Examiner* — Daniel L Greene
(74) *Attorney, Agent, or Firm* — Faegre Baker Daniels LLP

(57) ABSTRACT

A large manipulator includes a boom arm with a turntable and a plurality of boom segments, which are configured to be pivoted at respective articulation joints with respect to an adjacent boom segment or the turntable. The boom arm further includes at least one inertial sensor configured to measure inclination and/or acceleration of at least one of the plurality of boom segments.

15 Claims, 5 Drawing Sheets

(56) References Cited

U.S. PATENT DOCUMENTS

| | | | | |
|---|---|---|---|---|
| 2010/0139792 | A1* | 6/2010 | Rau | B66C 1/44 137/615 |
| 2015/0330060 | A1* | 11/2015 | Seki | E02F 9/264 701/33.1 |
| 2016/0084270 | A1* | 3/2016 | Specks | E04G 21/0436 60/445 |
| 2016/0237655 | A1* | 8/2016 | Baba | E02F 3/437 |
| 2016/0251824 | A1* | 9/2016 | Arimatsu | E02F 3/435 701/50 |

FOREIGN PATENT DOCUMENTS

| | | | |
|---|---|---|---|
| JP | 6102312 | A | 1/1986 |
| WO | 2014165889 | A1 | 10/2014 |

OTHER PUBLICATIONS

International Search Report and Written Opinion (English translation) issued in PCT/EP2016/053596, dated Jun. 20, 2016, 9 pages.

* cited by examiner

POSITION CONTROL OF A BOOM TIP

CROSS-REFERENCE TO RELATED APPLICATION

This application claims priority to International Patent Application No. PCT/EP2016/053596, filed 19 Feb. 2016, which claims the benefit of DE Application No. 10 2015 102 368.7, filed 19 Feb. 2015, both of which are herein incorporated by reference in their entireties.

TECHNICAL FIELD

The invention relates to a large manipulator having a boom arm, which can be folded out and comprises a turntable which can be rotated about a vertical axis and a multiplicity of boom segments, wherein the boom segments can be pivoted to a limited extent at articulation joints about respectively horizontal bending axes with respect to an adjacent boom segment or the turntable by means of one drive assembly in each case, and wherein means for measuring inclination and an auto concrete pump with a large manipulator according to the invention are arranged on the boom arm.

BACKGROUND

In modern auto concrete pumps, double piston pumps are generally used to feed the liquid concrete. The change between the active phases of the individual pistons gives rise to an interruption in the flow of concrete. Particularly at high feed rates this causes the jib to be excited in an impulsive fashion. This cyclic excitation gives rise to movements at the tip of the jib which constitute an nuisance during operation for the driver of the end hose. The prior art has disclosed a multiplicity of systems for actively damping elastic oscillations of the jib. Although this reduces the movements and can prevent resonance phenomena given an unfavorably adjusted pump frequency, satisfactory compensation of the movements of the jib is, rather, not possible with this.

DE 195 03 895 A1 discloses a simple position control circuit which compensates the vertical movement. However, the necessary technical measurement of the height proves problematic here. For this purpose, ultrasonic sensors and laser sensors are proposed for measuring the distance between the jib arm tip and the ground. However, this measuring principle is unfeasible in practical use since during operation it is not possible to ensure an obstacle-free space between the emitting source and the reference plane. Furthermore, it is proposed only to use the last boom joint for the implementation of the control. However, this control concept cannot be used for inclinations of the mast with respect to the gravitational field of the earth near to the vertical.

Furthermore, EP 1 537 282 B1 discloses that the height of the boom tip can be sensed relative to the height of the vehicle by means of inclination sensors which are mounted on all the boom segments. By measuring the inclinations with respect to the gravitational field of the earth it is possible to calculate the position of the boom tip with a kinematic description of the system. In this context, it is advantageous that the use of inclination sensors also causes the deformation of the boom segments to be implicitly taken into account. However, the inclination sensors which are typically used cannot differentiate between a change in the inclination and a translatory acceleration of the sensor. In the case of dynamic movements, said sensors therefore supply incorrect measurement values. Therefore they cannot be used to implement position control.

SUMMARY

An object of the present invention is therefore to further develop the known large manipulators in such a way that the dynamics of the system can be measured by measuring technology and used by control technology. Overall, a large manipulator is to be made available in which a vertical movement of a jib tip of an auto concrete pump can be effectively reduced during operation of the pump, which leads, inter alia, to an essential relief for the driver of the end hose.

This object is achieved by means of a large manipulator and concrete pump having the features of the claims. It is to be noted that the features which are specified individually in the claims can also be combined with one another in any desired technically appropriate fashion and therefore disclose further configurations of the invention.

The large manipulator according to the invention comprises a boom arm, which can be folded out and comprises a turntable which can be rotated about a vertical axis and a multiplicity of boom segments, wherein the boom segments can be pivoted to a limited extent at articulation joints about respectively horizontal bending axes with respect to an adjacent boom segment or the turntable by means of one drive assembly in each case. The large manipulator according to the invention is defined by the fact that it has at least one inertial sensor for measuring the inclination and/or the acceleration of at least one boom segment.

By means of the large manipulator according to the invention it is possible to prevent the falsifications of translatory accelerations which are known from the prior art. The large manipulator according to the invention thus has the advantage over the prior art that it permits statically and dynamically accurate measurement of the vertical movements of the boom tip to be achieved.

An inertial sensor according to the invention is preferably an acceleration sensor which senses the vertical acceleration at the location of the sensor. The inertial sensor is particularly preferably a combined sensor which has both a two-axis acceleration sensor and a rotational speed sensor. The axis of the rotational speed sensor is ideally positioned orthogonally with respect to the acceleration axis. Since the translatory movements have only a very small influence on the rotational speed sensor, the measurement signals of the rotational speed sensor can be used to detect and correct a falsification of the angle of inclination which is determined from the measurement signals of the acceleration sensor. In one practical implementation, the angle of inclination can be determined by chronological integration of the measured rotational speed, wherein the angle of inclination which is determined by the acceleration sensors is used for stationary adjustment. As a result, in the case of dynamic movements of the inertial sensor a movement error is reduced. A gyroscope is advantageously used. The gyroscope measures the rotational speed of the inclination which is not influenced by the translatory movement. For example an observer in the form of an expanded Kalman filter or an attachment with complementary filters can be used to combine the measurement signals of the acceleration sensors and those of the rotational speed sensor.

At least one inertial sensor can be arranged on each boom segment. As a result, the measuring accuracy and the measuring reliability can be improved further.

The inertial sensors are advantageously arranged essentially in the center of a boom segment. Owing to the narrow design of the boom arm, the individual boom segments experience considerable elastic deformations during operation as a result of the static and dynamic forces which occur. As a result of the arrangement of the sensors in the center of the boom segments, the difference between the measured inclinations of two successive boom segments includes not only the precise articulation angle but also a portion of the elastic deformation. As a result, the kinematics of the boom arm can be considered approximately as a rigid body problem. Ideally, each boom segment has an inertial sensor, wherein this inertial sensor is arranged approximately in the center of the respective boom segment.

It is advantageous if the inertial sensor is arranged on the last boom segment. According to the invention this is to be understood as being the boom segment which is arranged furthest away from the turntable and at whose outer end an end hose is preferably mounted. The inertial sensor is particularly preferably not arranged in the center on the last boom segment. Since the influence of the beam curvature of the last boom segment on the height of the boom tip is low in relation to those of the preceding boom segments, such an arrangement gives rise to a sufficiently precise measurement result. Ideally, the boom arm has an inertial sensor on the boom tip. As a result, the measurement of the height of the boom tip in the case of rapid movement with high accelerations can be improved further. The double chronological integration of the measurement signal which passes on the acceleration in the vertical direction supplies a signal which has a good correspondence with the dynamic portions of movements in the vertically high frequency band. According to the invention, two sensors may be arranged on the last boom segment. One sensor is preferably arranged essentially in the center and another sensor on the boom tip, that is to say at the outer end of the boom segment. However, for a sufficiently precise measurement it is also sufficient if a sensor is arranged only on the boom tip.

In one advantageous configuration, at least one of the articulation joints of the boom arm is assigned an angle sensor which senses the angular position of this articulation joint. Particularly preferably each articulation joint is provided with an angle sensor in each case. In this configuration, the large manipulator can advantageously be configured to calculate (by means of a suitable computer) the height of the boom tip from the sensed angular positions of the articulation joints in combination with the acceleration sensed by means of the inertial sensor arranged on the last boom segment, in particular on the boom tip. The angle sensors are not inertial sensors but rather measuring pickups with geometric resolution (with a mechanical, resistive, inductive, optical or magnetic operating principle). The angle sensors serve, in other words, to determine the (statistical) position of the boom arm. According to the invention, the height of the boom tip can firstly be determined by means of the angular positions of the articulation joints. In order to optimize the accuracy, in this context the sagging of the boom segments can be taken into account. This can be done e.g. on the basis of mathematical models alone or in combination with further measurement signals such as e.g. pressure sensors on the hydraulic drive assemblies of the boom arm. The value of the height of the boom tip which is obtained in this way can then be combined with the high-pass filtered vertical acceleration signal, integrated twice chronologically, of the inertial sensor which is arranged on the last boom segment or on the boom tip, and in this way provides a particularly accurate measurement value of the height of the boom tip. In this configuration, just precisely one inertial sensor in the form of an acceleration sensor in combination with a number of angle sensors is required, corresponding to the number of articulation joints.

Alternatively, the measurement signals, i.e. the measurement signal of the vertical acceleration and the height measurement signal determined by means of the angles of inclination can preferably also be combined with one another by means of suitably selective, preferably complementary, filters. The height of the boom tip which is determined by means of the inclinations of the boom segments is filtered with a low-pass filter with a suitable cutoff frequency, in order to filter out high-frequency dynamic interference. The vertical acceleration signal which is integrated twice chronologically is filtered with a complementary high-pass filter with the same cutoff frequency. The two filtered signals are subsequently combined and provide a precise measurement result of the height of the boom tip. As an alternative to the implementation by means of complementary filters, their function can also be implemented by means of an observer or a Kalman filter.

The large manipulator according to the invention preferably has a position controller. By means of the position controller, it is possible to implement an effectively acting control of the height of the boom tip, as a result of which an induced vertical movement of the boom tip is compensated. The height of the boom tip can be manipulated as a function of the inclinations of the individual joint, in principle with each joint. Whereas in the case of inclinations of the assigned boom segment near to the horizontal for the respective joint a large degree of manipulation capability is provided, this disappears in the case of the inclinations near to the vertical. However, for the implementation of the position control the problem of the selection of the actuator element to be used thus results. It is known that the measurement of the coordinates of the jib tip (height and radius) can be used for the implementation of what is referred to as a Cartesian or cylindrical control of the jib tip. In this context, the user can selectively predefine for the boom tip an extension movement or shortening movement with a single joystick, which has at least two adjustment directions, while retaining the height, or the user can predefine a lifting or lowering movement while retaining the radius. By means of the joystick predefinitions, actuation signals for the hydraulic actuators of the individual joints are calculated with an algorithm, said actuation signals initiating the desired movement. With such an algorithm the problem of the selection of the actuator element to be used for the position control is solved. In this context, the position controller preferably feeds back to the system the deviation of the measured height of the boom tip from its set point value as a predefinition of a lifting movement or a lowering movement of the boom tip for a, for example, Cartesian or cylindrical control.

A closed-loop control circuit for damping the oscillation of the boom is preferably implemented on the basis of the control of the articulation angles. This closed-loop control circuit preferably has a computer unit which calculates the height of the boom tip on the basis of a kinematic description of the boom and of the measurements of the angles of inclination of the individual boom segments with respect to the gravitational field of the earth. The angular speeds of the individual articulation joints are preferably considered as manipulated variables of this oscillation-damping closed-loop control circuit.

The position control system according to the invention is preferably superimposed on the damping of the oscillation.

The position control system preferably has a proportional/integral/differential controller (PID controller). The controller determines, by means a control error (actual/set point value of the height of the boom tip) a control output which is predefined to the boom tip in the form of a lifting movement or a lowering movement as set point movement. The algorithm determines therefrom the actuated signals which are connected to the actuation inputs of the individual boom joints, i.e. in practice the control inputs of the proportional hydraulic valves of the hydraulic drives. According to the invention, the algorithm is formed in such a way that by means of the orientation of the individual boom arms and/or the distance of the individual boom joints from the turntable a weighting takes place with which the actuation signals which are connected to the actuation inputs of the individual boom joints are weighted. On the one hand, the weighting increases the further the joint is away from the turntable or the closer the arrangement of the joint on the jib arm tip. The actuation of the boom joint further away from the turntable provides the advantage that the mass to be moved is lower, and therefore a change in position can be counteracted more quickly and effectively. On the other hand, the weighting increases the more horizontal the course of the individual boom arms. The control system should as far as possible act on the horizontally running boom arms in order to be able to effectively increase the height of the jib arm tip. The algorithm according to the invention or the weighting is expediently executed here in such a way that basically the largest actuation signal is applied to the last boom arm if it has an approximately horizontal course. However, if the last boom arm runs essentially vertically, then another boom arm with a more horizontal profile receives a larger weighting and a correspondingly larger actuation signal is applied to it. In this way, it is possible overall to implement an effectively acting control of the height of the jib arm tip with the sensor concept and control concept according to the invention.

The set point value for the height of the boom tip is preferably determined during practical operation by the method of the operator and results here from the position of rest for the respective current position of the boom arm. The large manipulator according to the invention is preferably used for distributing thick materials. In particular, it serves to feed concrete.

In addition, the subject matter of the invention is an auto concrete pump. The auto concrete pump according to the invention has a vehicle chassis, a thick material pump, in particular a concrete pump, which is arranged on the vehicle chassis, and a large manipulator with the inertial sensors described above.

The invention and the technical field are explained in more detail below with reference to the figures. It is to be noted that the figures each show a particularly preferred embodiment variant of the invention. However, the invention is not restricted to the embodiment variants shown. In particular the invention, insofar as is technically appropriate, comprises any desired combinations of the technical features which are disclosed in the claims or described as relevant to the invention in the description.

DETAILED DESCRIPTION

Figure 1:
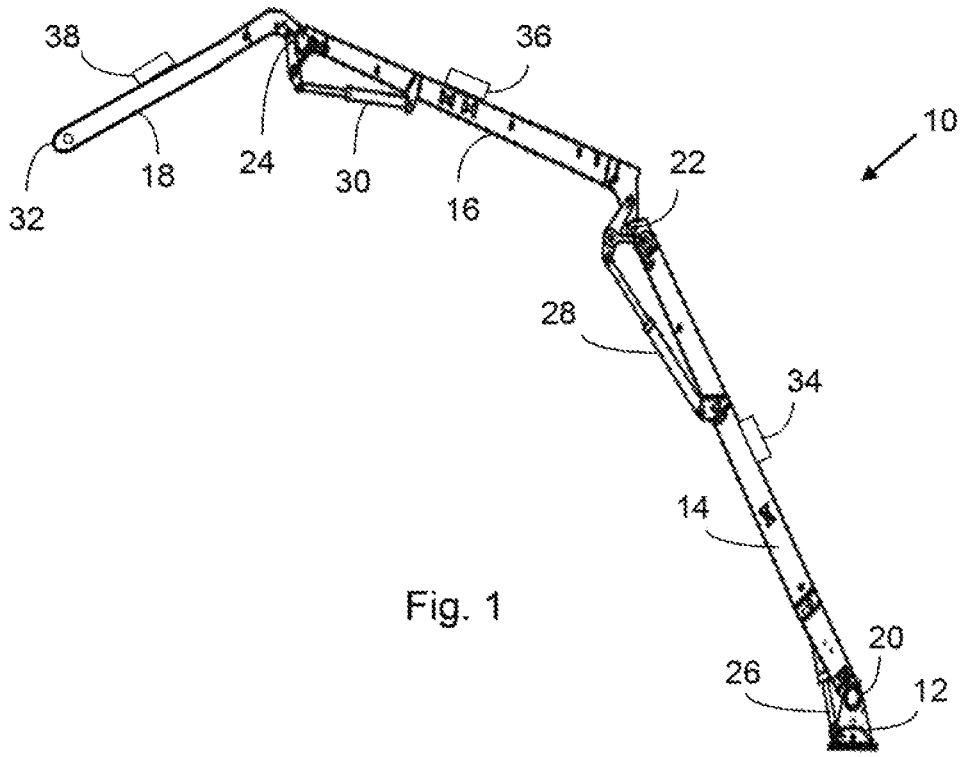
FIG. 1 shows a schematic view of a boom arm according to the invention in a first configuration.

FIG. 1 shows a schematic illustration of a boom arm 10 according to the invention with means 34, 36, 38 for measuring the inclination in a first configuration. The large manipulator has a boom arm 10 which can be folded out and which has a turntable 12 which can be rotated about a vertical axis and a multiplicity of boom segments 14, 16, 18. The boom segments 14, 16, 18 can be pivoted to a limited extent with respect to an adjacent boom segment 14, 16, 18 or the turntable 12, in each case by means of one drive assembly 26, 28, 30. The boom arm 10 preferably has between three and five boom segments 14, 16, 18. The large manipulator according to the invention has at least one inertial sensor 34, 36, 38 for sensing the inclination of the boom segments 14, 16, 18 with respect to the earth. The inertial sensors 34, 36, 38 are each preferably composed of a two-axis acceleration sensor and a rotational speed sensor. The axis of the rotational speed sensor is ideally positioned orthogonal on the acceleration axes of the acceleration sensor. Since the translatory movements only have a very small influence on the rotational speed sensors, the measurements thereof are used to detect and correct falsifications of the angles of inclination which are determined from the acceleration measurements and to correct them. As a result, a measurement error during movements of the boom is reduced.

The boom arm 10 according to the invention as illustrated in FIG. 1 has an inertial sensor 34, 36, 38 on each boom segment 14, 16, 18. The inertial sensors 34, 36, 38 are arranged essentially in the center of the boom segments 14, 16, 18. As a result of such an arrangement of the sensors 34, 36, 38, the difference between the measured inclinations of two successive boom segments 14, 16, 18 includes not only the precise articulation angle but also a portion of the elastic deformation. This can adversely affect the kinematics of the boom arm approximately as a rigid body problem.

Figure 2:
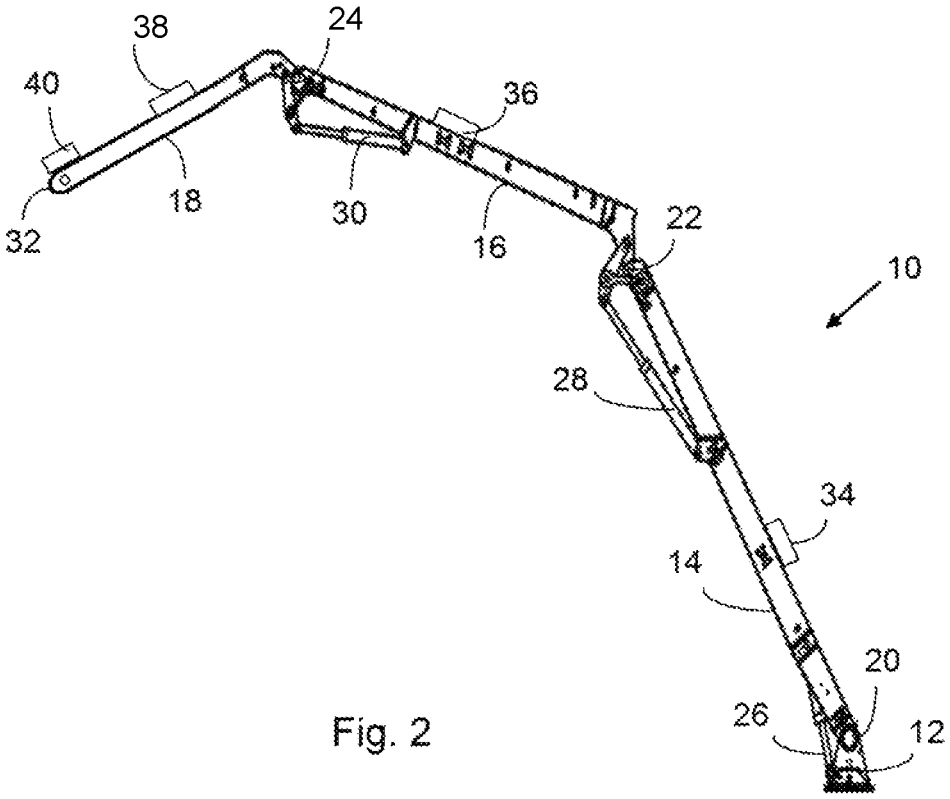
FIG. 2 shows a schematic view of a boom arm according to the invention in a second configuration.

FIG. 2 shows a schematic illustration of a boom arm 10 according to the invention with means for measuring the inclination in a second configuration. The boom segments 14, 16, 18 each have an inertial sensor 34, 36, 38 which is arranged essentially in the center thereof. In order to improve the measurement of the height of the boom tip 32 further, in particular in the case of rapid movements with large accelerations, an additional measurement of the accelerations is made directly on the boom tip 32. The double chronological integration of the portion of the acceleration in the vertical direction supplies a measurement signal which has a good degree of correspondence with the dynamic portions of the movement sequence in the upper frequency band. For this purpose, the boom segment 18, whose outer end constitutes the boom tip 32, has an additional sensor 40 at its outer end, of the boom tip 32.

However, for sufficiently precise measurements it is also sufficient if just one sensor is arranged on the boom tip.

Figure 3:
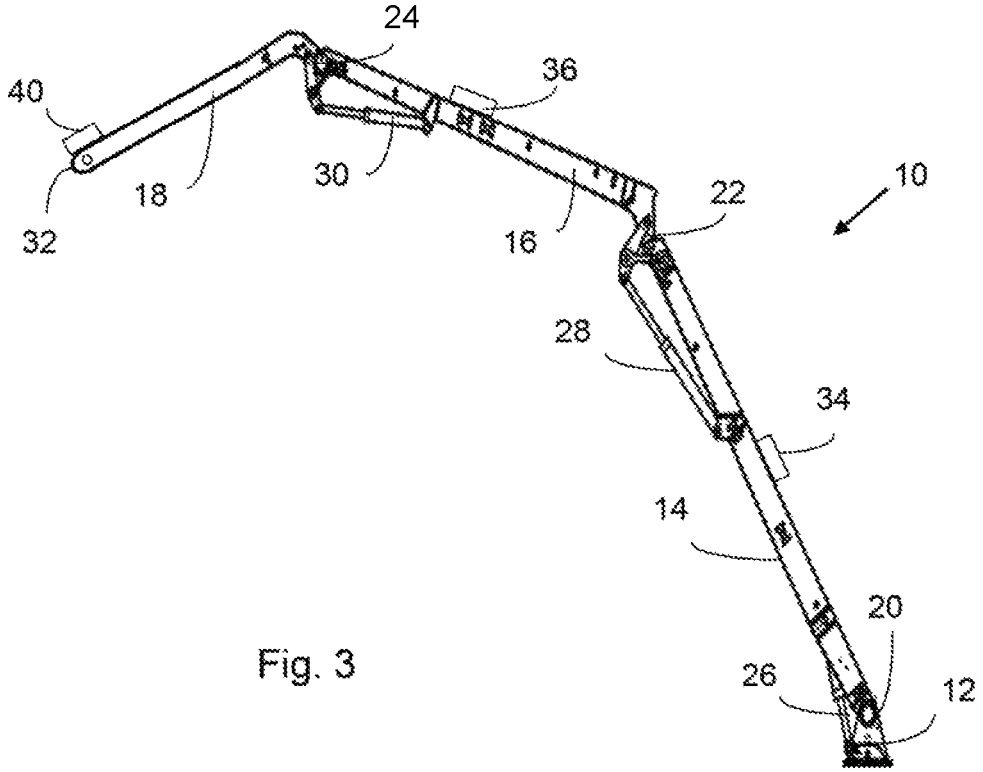
FIG. 3 shows a schematic view of a boom arm according to the invention in a third configuration.

FIG. 3 shows a schematic illustration of a boom arm 10 according to the invention with the means for measuring the inclination in a third configuration. The boom segments 14, 16 each have an inertial sensor 34, 36 which are arranged essentially in the center thereof. The boom segment 18 has an inertial sensor 40 at the outer end thereof, of the boom tip 32. Since the influence of the beam curvature of the last boom segment 18 on the height of the boom tip is small in relation to that of the preceding boom segments 14, 16, such an arrangement gives rise to a sufficiently precise measurement result. It is therefore possible to dispense with an additional sensor 38.

Figure 4:
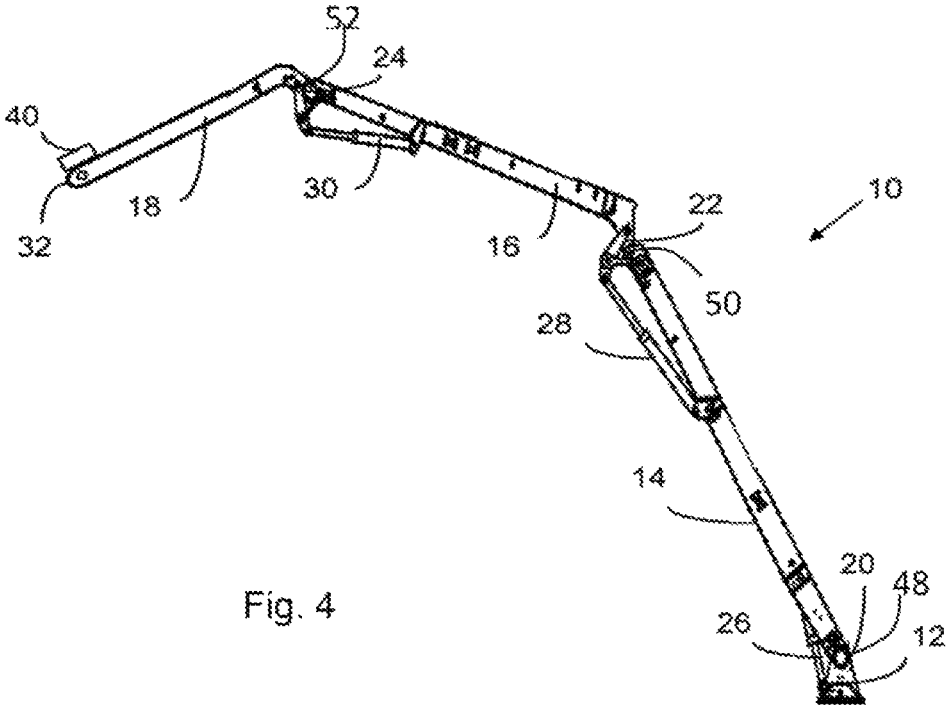
FIG. 4 shows a schematic view of a boom arm according to the invention in a fourth configuration.

FIG. 4 shows a schematic view of a boom arm 10 according to the invention in a fourth embodiment. The boom segments 14, 16, 18 each have an angle sensor 48, 50, 52. The angle sensors 48, 50, 52 sense the angular positions of the individual articulation joints 20, 22, 24. In addition, an inertial sensor 40, which senses the vertical acceleration of the boom tip 32, is arranged on the boom tip 32. By combining the signals of the angle sensors 48, 50, 52 with the signals of the inertial sensor 40 it is possible to implement a very precise determination of the continuous height of the boom tip 32.

Figure 5:
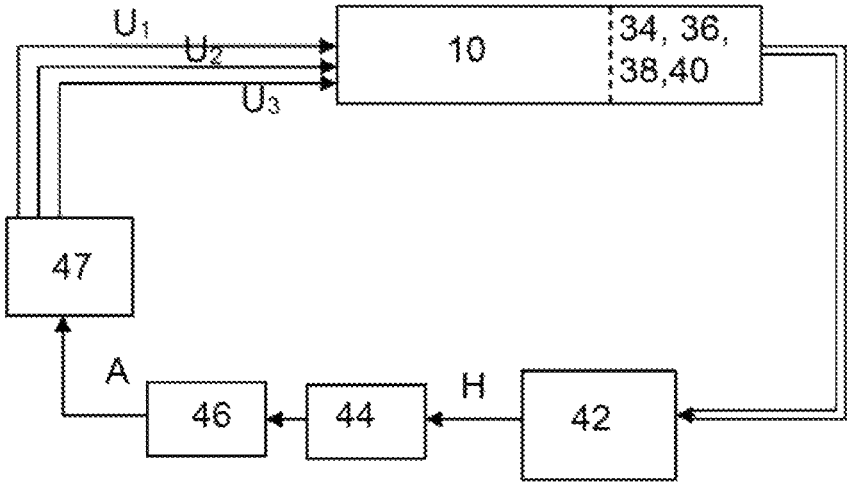
FIG. 5 shows a schematic closed-loop control circuit according to an embodiment of the invention.

With the illustrated sensor concept it is possible to implement an effectively acting control of the height of the jib tip. This is shown schematically in FIG. 5.

It is assumed here that a control of the articulation angles is implemented in order to damp the oscillation of the boom arm 10. The angular speeds of the individual joints 20, 22, 24 are here the manipulated variables U1, U2, U3 of the system.

According to the invention, a position control on the basis of a PID controller 46 and a module 47 for controlling the lifting movement or lowering movement of the boom tip 32 is superimposed on the damping of the oscillation. The instantaneous height H of the boom tip is determined by means of a computer 42 from the measurement signals of the inertial sensors 34, 36, 38, 40 arranged on the boom 10 (see FIG. 2) or from the signals of the angle sensors 48, 50, 52 in combination with the signal of the inertial sensor 40 (see FIG. 4) as described above. The position control determines, by means of the control error (deviation of the actual value of the height of the boom tip 32 from its set point value), a controller output A which is predefined as a set point value in the form of a lifting movement or a lowering movement of the boom tip for the module 47. Said position controller calculates the control signals which are applied to the manipulated variables U1, U2 and U3 of the individual joints 20, 22 and 24.

The set point value for the height of the boom tip 32 is determined during practical operation by the method of the operator and therefore arises from the position of rest for the respective current position of the boom arm 10. A precise calculation of the position of rest of the height of the boom tip 32 by means of the current stationary values of the articulation angles is not possible because of the complexity of the overall system and the only imprecise knowledge of the model parameters for the practical operation, and it is not necessary either.

Therefore, a simple high-pass filter 44 with a suitably selected cutoff frequency is used for the PID controller 46 for determining the control error. Drifting away of the height from the original position as a result of the controller intervention is prevented by the underlying oscillation-damping control, which includes control of the articulation positions. As a result of the illustrated control, vertical movements of the boom tip 32, e.g. of an auto concrete pump, can be effectively reduced during the pumping operation.

LIST OF REFERENCE NUMBERS

10 Boom arm
12 Turntable
14 First boom segment
16 Second boom segment
18 Third boom segment
20 First articulation joint
22 Second articulation joint
24 Third articulation joint
26 First drive element
28 Second drive element
30 Third drive element
32 Boom tip
34 First inertial sensor
36 Second inertial sensor
38 Third inertial sensor
40 Inertial sensor of boom tip
42 Computer
44 High-pass filter
46 PID controller
47 Module for controlling the lifting and lowering movement of the boom tip
48 First angle sensor
50 Second angle sensor
52 Third angle sensor

The invention claimed is:

1. A large manipulator comprising:

a boom arm configured to be folded out and comprising:

a turntable configured to be rotated about a vertical axis, a plurality of boom segments configured to be pivoted at respective articulation joints about respective horizontal bending axes with respect to an adjacent boom segment or the turntable by means of a drive assembly, wherein a last of the plurality of boom segments includes a boom tip, and a first inertial sensor arranged at the boom tip and configured to measure acceleration of the last boom segment and generate a responsive sensor signal; and a position control system configured to control a vertical position of the boom tip based, at least in part, on either measured inclinations of the plurality of boom segments or measured angular positions of the respective articulation joints, in combination with a double chronological integration of the measured acceleration, in a vertical direction, sensed by the first inertial sensor.

2. The large manipulator of claim 1, wherein each of the boom segments includes a first end portion, a second end portion, and a center portion extending between the first and the second end portions, wherein a second inertial sensor is positioned substantially in a center of the center portion.

3. The large manipulator of claim 1, further comprising:

a computer configured to calculate the vertical position of the boom tip.

4. The large manipulator of claim 1, further comprising:

an angle sensor arranged on one of the articulation joints and configured to sense angular position of the articulation joint.

5. The large manipulator of claim 1, further comprising:

an angle sensor arranged on each of the articulation joints, wherein each angle sensor is configured to sense angular position of one of the respective articulation joints.

6. The large manipulator of claim 1, wherein the position control system is further configured to damp oscillations of the plurality of boom segments.

7. The large manipulator of claim 6, wherein the position control system includes a proportional-integral-differential controller.

8. The large manipulator of claim 1, wherein the first inertial sensor comprises both a two-axis acceleration sensor and a rotational speed sensor.

9. The large manipulator of claim 8, further comprising:

an observer configured to combine measurement signals of the two-axis acceleration sensor with a chronologically integrated measurement signal of the rotational speed sensor.

10. The large manipulator of claim 9, wherein the observer is an extended Kalman filter.

11. The large manipulator of claim 1, further comprising:

at least one inertial sensor arranged on each of the plurality of boom segments.

12. A concrete pump comprising:

a vehicle chassis;

a thick matter pump arranged on the vehicle chassis; and the large manipulator of claim 1.

13. A method for use with a large manipulator including a boom arm with a plurality of boom segments pivotable at respective articulation joints, the last of the plurality of boom segments including a boom tip, and an inertial sensor positioned on the boom tip, the method comprising:

measuring, via the inertial sensor, acceleration of the last of the plurality of boom segments;

measuring one or more of: inclinations of the plurality of boom segments and angular positions of the respective articulation joints; and calculating, via a computer, a vertical position of the boom tip based, at least in part on, either the measured inclinations of the plurality of boom segments or the measured angular positions of the respective articulation joints, in combination with a double chronological integration of the measured acceleration, in a vertical direction, sensed by the inertial sensor.

14. The method of claim 13, wherein the inertial sensor comprises a two-axis acceleration sensor and a rotational speed sensor, the method further comprising:

calculating, via the computer, the vertical position of the boom tip based, at least in part, on acceleration sensed by the two-axis acceleration sensor.

15. The method of claim 13, further comprising:

controlling, via a position control system, the vertical position of the boom tip based, at least in part, on the measured inclinations.

* * * * *